US012078175B2

(12) United States Patent
Lee et al.

(10) Patent No.: US 12,078,175 B2
(45) Date of Patent: Sep. 3, 2024

(54) COMPRESSOR

(71) Applicant: LG Electronics Inc., Seoul (KR)

(72) Inventors: Jaeha Lee, Seoul (KR); Sungyong Ahn, Seoul (KR); Howon Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/919,934

(22) PCT Filed: Mar. 8, 2021

(86) PCT No.: PCT/KR2021/002815
§ 371 (c)(1),
(2) Date: Oct. 19, 2022

(87) PCT Pub. No.: WO2021/215651
PCT Pub. Date: Oct. 28, 2021

(65) Prior Publication Data

US 2023/0204035 A1 Jun. 29, 2023

(30) Foreign Application Priority Data

Apr. 20, 2020 (KR) ..... 10-2020-0047716

(51) Int. Cl.
*F04C 29/12* (2006.01)
*F04C 18/02* (2006.01)
(Continued)

(52) U.S. Cl.
CPC ..... *F04C 29/124* (2013.01); *F04C 18/0215* (2013.01); *F04C 29/023* (2013.01); *F04C 29/065* (2013.01)

(58) Field of Classification Search
CPC ..... F04C 18/0215; F04C 18/0261; F04C 18/0292; F04C 23/008; F04C 28/22; F04C 29/02; F04C 29/043
See application file for complete search history.

(56) References Cited

U.S. PATENT DOCUMENTS

2015/0176585 A1* 6/2015 Sun ..... F04C 29/128 137/493
2016/0252094 A1* 9/2016 Hayashi ..... F04C 18/322 137/855
2018/0202440 A1* 7/2018 Lee ..... F04C 18/0215

FOREIGN PATENT DOCUMENTS

JP 58172482 A * 4/1982 ..... F04C 29/128
JP 2002-349458 12/2002
(Continued)

OTHER PUBLICATIONS

English translation of JP2019023450 by PE2E Aug. 15, 2023.*
(Continued)

*Primary Examiner* — Deming Wan
(74) *Attorney, Agent, or Firm* — Fish & Richardson P.C.

(57) ABSTRACT

A compressor comprises a discharge valve which is provided so as to be coupled to a fixed scroll and open/close a discharge hole. The discharge valve includes a coupling portion which is coupled to one surface of the fixed scroll, the surface facing a muffler, and a head portion extending from the coupling portion and opening/closing the discharge hole. The head portion may be provided with a communicating hole for allowing the discharge hole and the muffler to be in communication with each other. Accordingly, a backflow of a compressed refrigerant is prevented during the operation of the compressor, and thus over-compression of the refrigerant can be prevented. Also, when the compressor stops operating, only a certain amount of the discharged refrigerant is allowed to flow backward to prevent a reverse rotation of an orbiting scroll and a decrease in the oil level of the oil stored in a case.

18 Claims, 6 Drawing Sheets

(51) Int. Cl.

| | |
|---|---|
| ***F04C 23/00*** | (2006.01) |
| ***F04C 29/02*** | (2006.01) |
| ***F04C 29/04*** | (2006.01) |
| ***F04C 29/06*** | (2006.01) |

(56) References Cited

FOREIGN PATENT DOCUMENTS

| | | | | | |
|---|---|---|---|---|---|
| JP | 2019023450 | A | * | 2/2019 | ..... F04B 39/10 |
| KR | 20030051083 | | | 6/2003 | |
| KR | 20080060939 | | | 7/2008 | |
| KR | 20130011864 | | | 1/2013 | |
| KR | 20190000035 | | | 1/2019 | |

OTHER PUBLICATIONS

English translaiton of JP58172482 by PE2E Aug. 15, 2023.*
International Search Report and Written Opinion in International Appln. No. PCT/KR2021/002815, dated Jun. 21, 2021, 15 pages (with English translation).

* cited by examiner (a)

(b)

COMPRESSOR

CROSS-REFERENCE TO RELATED APPLICATIONS

This application is a National Stage application under 35 U.S.C. § 371 of International Application No. PCT/KR2021/002815, filed on Mar. 8, 2021, which claims the benefit of Korean Application No. 10-2020-0047716, filed on Apr. 20, 2020. The disclosures of the prior applications are incorporated by reference in their entirety.

TECHNICAL FIELD

The present disclosure relates to a compressor, and more particularly to a scroll compressor provided with a discharge valve having a communication hole.

BACKGROUND

Generally, a compressor is an apparatus for use in a refrigerating cycle (hereinafter referred to as a refrigeration cycle), for example, a refrigerator or an air conditioner. The compressor is an apparatus that provides a work or task required to generate heat exchange in the refrigeration cycle by compressing refrigerant.

The compressor may be classified into a reciprocating compressor, a rotary compressor, a scroll compressor, etc. according to a method for compressing the refrigerant. The scroll compressor is a compressor in which an orbiting scroll performs an orbiting motion by engaging with a fixed scroll fixed into an inner space of a hermetic container such that a compression chamber is formed between a fixed wrap of the fixed scroll and an orbiting wrap of the orbiting scroll.

The scroll compressor may obtain a relatively higher compression ratio because fluid can be continuously compressed through scroll shapes engaged with each other as compared to other types of compressors, and has advantages in that suction, compression, and discharge cycles of refrigerant are smoothly performed to obtain a stable torque. For this reason, the scroll compressor has been widely used for refrigerant compression in an air conditioner or the like.

Referring to Japanese Patent Registration No. 6344452, a conventional scroll compressor may include a case forming an outer appearance thereof and having a discharge port through which refrigerant is discharged, a compression part fixed into the case to compress the refrigerant, and a drive unit fixed into the case to drive the compression unit. The compression unit and the drive unit may be coupled to each other through a rotary shaft that rotates by coupling to the drive unit.

The compression unit may include a fixed scroll and an orbiting scroll. The fixed scroll is fixed into the case and includes a fixed wrap. The orbiting scroll includes an orbiting wrap that is driven by engaging with the fixed wrap through the rotary shaft. In the conventional scroll compressor, the rotary shaft is eccentrically provided therein, and the orbiting scroll is fixed into the eccentric rotary shaft and rotates with the eccentric rotary shaft. Thus, the orbiting scroll may compress the refrigerant while revolving (or orbiting) along the fixed scroll.

Generally, the conventional scroll compressor includes a compression unit provided at a lower part of the discharge port and a drive unit provided at a lower part of the compression unit. One end of the rotary shaft may be coupled to the compression unit, and the other end of the rotary shaft may pass through the drive unit.

The conventional scroll compressor has disadvantages in that the compression unit is provided above the drive unit and is located closer to the discharge port so that it is difficult to supply oil to the compression unit and a lower frame is additionally required to separately support the rotary shaft connected to the compression unit at a lower part of the drive unit. In addition, the conventional scroll compressor has other disadvantages in that gas force generated by the refrigerant in the compressor is different in action point from reaction force supporting the gas force so that scroll tilting may unavoidably occur, resulting in reduction in efficiency and reliability of the compressor.

In order to address the above-mentioned issues, referring to Korean Patent Laid-Open Publication No. 10-2018-0124636, an improved scroll compressor (also called a lower scroll compressor) in which a drive unit is provided at a lower part of the discharge port and a compression unit is located at a lower part of the drive unit has recently been developed.

In the lower scroll compressor, the discharge port is located closer to the drive unit than the compression unit, and the compression unit is located farthest from the discharge port.

The lower scroll compressor has advantages in that one end of the rotary shaft is connected to the drive unit and the other end of the rotary shaft is supported by the compression unit in a manner that a lower frame can be omitted such that oil stored in a lower part of the case can be directly supplied to the compression unit without passing through the drive unit. In addition, in the event that the rotary shaft of the lower scroll compressor is connected to the compression unit while passing through the compression unit, an action point of gas force and an action point of reaction force are identical to each other on the rotary shaft, so that vibrations of the scrolls or overturning moments of the scrolls are offset against each other, resulting in guarantee of efficiency and reliability in the lower scroll compressor.

Meanwhile, Korean Patent Registration No. 10-1480472 discloses a differential pressure oil-feeding structure in a lower scroll compressor. However, when the compressor stops operation, the compressed high-temperature and high-pressure refrigerant gas may flow back.

Korean Patent Laid-Open Publication No. 10-2018-0086749 discloses a suction valve provided in a refrigerant suction port of the lower scroll compressor. However, when the suction valve is installed in the suction port, the orbiting scroll may be reversely rotated by backflow of refrigerant gas when the compressor stops operation.

In addition, a discharge valve may be installed in a refrigerant discharge hole, but there is a problem in that oil is supplied to the compression unit even after the operation of the compressor is stopped.

DISCLOSURE

Technical Problem

According to the present embodiment, an object of the present disclosure is to provide a compressor that prevents a reverse flow of refrigerant generated when the internal pressure of the compressor becomes higher than a discharge pressure of a compression unit in a situation where the compressor operates under a condition corresponding to a compression ratio higher than a designed compression ratio.

Another object of the present disclosure is to provide a compressor that prevents reverse rotation of the orbiting scroll when the compressor stops operation.

In addition, another object of the present disclosure is to provide a compressor that prevents the level of stored oil from being lowered when the compressor is stopped.

Technical Solutions

In order to solve the above-described problems, an object of the present disclosure is to provide a compressor having a discharge valve provided with a communication hole. Specifically, the present disclosure provides a compressor in which the communication hole is optimally designed in the discharge valve.

In accordance with the present embodiments, a compressor may include a case including a discharge port through which refrigerant is discharged and a reservoir space in which oil is stored; a drive unit coupled to an inner circumferential surface of the case; a rotary shaft configured to rotate by coupling to the drive unit; a compression unit coupled to the rotary shaft to compress the refrigerant so that the compressed refrigerant is discharged in a direction farther from the discharge port; and a muffler coupled to the compression unit and configured to guide the refrigerant to the discharge port.

The compression unit may include an orbiting scroll coupled to the rotary shaft and configured to perform an orbital motion when the rotary shaft rotates; a fixed scroll provided in engagement with the orbiting scroll to receive the refrigerant so that the received refrigerant is compressed and discharged; a main frame seated in the fixed scroll to accommodate the orbiting scroll so that the rotary shaft penetrates the main frame; a discharge hole provided in the fixed scroll such that the refrigerant is sprayed in a direction farther from the discharge port; and a discharge valve coupled to the fixed scroll and configured to open and close the discharge hole.

The discharge valve may include a coupling portion coupled to one surface of the fixed scroll facing the muffler; and a head portion extending from the coupling portion and provided to open and close the discharge hole. The head portion may include a communication hole through which the discharge hole and the muffler communicate with each other.

A cross-sectional area of the communication hole may be 5% to 10% of a cross-sectional area of the discharge hole.

The center of the communication hole may be arranged to coincide with a center of the discharge hole.

The communication hole may be formed in a cylindrical shape.

The head portion may be formed in a shape corresponding to the discharge hole.

The head portion may be formed to have the same cross-sectional area as the discharge hole.

The coupling portion may include a fastening portion fastened to one surface of the fixed scroll; and an extension portion extending from the fastening portion, having a cross-sectional area smaller than that of the fastening portion, and connected to the head portion.

The extension portion arranged in a central direction of the rotary shaft has a longer length than the fastening portion arranged in a central direction of the rotary shaft.

The compressor may further include a stopper coupled to the fastening portion to limit an opening displacement of the discharge valve.

The fastening portion may be formed of a material having a higher rigidity than the extension portion and the head portion.

The compressor may further comprise a fastening member coupled to one surface of the fixed scroll after passing through the fastening portion and the stopper.

The center of the communication hole may be located closer to the fastening portion than the center of the discharge hole.

The compressor may further include a coating member provided on an inner surface of the communication hole.

Advantageous Effects

According to the embodiments of the present disclosure, a compressor may prevent a reverse flow of refrigerant generated when the internal pressure of the compressor becomes higher than a discharge pressure of a compression unit in a situation where the compressor operates under a condition corresponding to a compression ratio higher than a designed compression ratio, so that the compressor can operate at a high-pressure ratio.

The compressor according to the embodiments of the present disclosure may prevent a reverse flow of refrigerant gas discharged when the compressor is stopped, thereby preventing reverse rotation of the orbiting scroll.

The compressor according to the embodiments of the present disclosure may prevent reverse rotation of the orbiting scroll when the compressor is stopped, thereby preventing occurrence of noise.

The compressor according to the embodiments of the present disclosure may prevent reverse rotation of the orbiting scroll when the compressor is stopped, thereby preventing damage to the orbiting scroll and the fixed scroll.

In addition, when the compressor for use in a differential pressure oil-feeding structure is stopped, the compressor can prevent oil from flowing into a compression unit and a suction port.

In addition, when the compressor for use in a differential pressure oil-feeding structure is stopped, the compressor can prevent the level of oil stored in a casing from being lowered.

In addition, when the compressor is stopped, the compressor may prevent oil from flowing into the compression unit and the suction port, so that the operation unable state of the compressor affected by high-viscosity oil generated when the compressor is restarted or left in a cold state can be prevented.

BEST MODE

Hereinafter, embodiments of the present disclosure will be described with reference to the accompanying drawings.

The following detailed description is provided to aid in a comprehensive understanding of the methods, apparatuses, and/or systems described herein. However, this is merely an example, and the present disclosure is not limited thereto.

In describing the embodiments of the present disclosure, a detailed description of known technologies related to the present disclosure will be omitted when it may make the subject matter of the present disclosure rather unclear. Furthermore, the terms as used herein are defined by taking functions of the invention into account and can be changed according to the custom or intention of users or operators. Therefore, the definitions should be made based on the contents throughout this specification. The terminology used in the detailed description is for the purpose of describing particular embodiments only and is not limiting. A singular representation may include a plural representation unless it represents a definitely different meaning from the context. Terms such as "include" or "has" are used herein and should be understood that they are intended to indicate existence of several components, functions or steps, disclosed in the specification, and it is also understood that greater or fewer components, functions, or steps may likewise be utilized.

Figure 1:
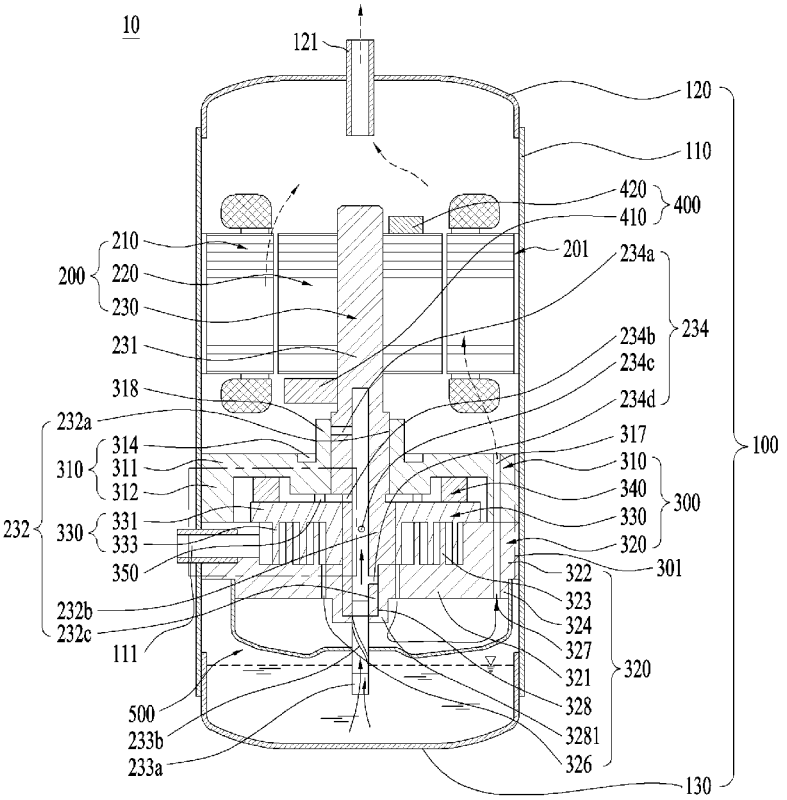
FIG. 1 is a view illustrating a basic configuration of a compressor according to an embodiment of the present disclosure.

FIG. 1 is a view illustrating a basic configuration of a compressor 10 according to an embodiment of the present disclosure. Specifically, FIG. 1 shows the internal structure of the compressor 10 and an oil supply structure.

Referring to FIG. 1, the compressor 10 may include a case 100, a drive unit 200, and a compression unit 300. The case 100 may include a reservoir space in which fluid is stored or moves. The drive unit 200 may be coupled to an inner circumferential surface so as to rotate a rotary shaft 230. The compression unit 300 may be coupled to the rotary shaft 230 in the case 100, and may be provided to compress fluid.

In more detail, the case 100 may include a discharge port 121 provided at one side thereof so that refrigerant is discharged through the discharge port 121. The case 100 may include a reception shell 110, a discharge shell 120, and an isolation shell 130. The reception shell 110 may be formed in a cylindrical shape, and may include the drive unit 200 and the compression unit 300. The discharge shell 120 may be connected to one end of the reception shell 110, and may include the discharge port 121. The isolation shell 130 may be coupled to the other end of the reception shell 110, and may seal the reception shell 110. In addition, the case 100 may further include a suction port 111 through which the refrigerant flows may be provided at one side of the reception shell 110.

The drive unit 200 may include a stator 210 to generate a rotary magnetic field, and a rotor 220 to rotate by the rotary magnetic field. The rotary shaft 230 may be coupled to the rotor 220, so that the rotary shaft 230 can rotate together with the rotor 220.

The stator 210 may include a plurality of slots. The plurality of slots may be formed at the inner circumferential surface of the stator 210 in a circumferential direction of the stator 210. Coils may be wound on the slots of the stator 210, so that the stator 210 can be fixed to the inner circumferential surface of the reception shell 110. The rotor 220 may be coupled to a permanent magnet, and may be rotatably coupled in the stator 210 to generate rotational power. The rotary shaft 230 may be press-fitted into a center point of the rotor 220.

The compression unit 300 may include a fixed scroll 320, an orbiting scroll 330, and a main frame 310. The fixed scroll 320 may be coupled to the reception shell 110, and may be provided in the drive unit 200 in the direction farther from the discharge port 121. The orbiting scroll 330 may be coupled to the rotary shaft 230, and may be engaged with the fixed scroll 320, resulting in formation of a compression chamber. The main frame 310 may include the orbiting scroll 330, and may be seated in the fixed scroll 320, resulting in formation of an outer appearance of the compression unit 300.

As a result, the compressor 10 may include the drive unit 200 disposed between the discharge port 121 and the compression unit 300. In other words, the drive unit 200 may be provided at one side of the discharge port 121, and the compression unit 300 may be provided in the drive unit 200 in the direction farther from the discharge port 121. For example, when the discharge port 121 is provided at an upper part of the case 100, the compression unit 300 may be provided at a lower part of the drive unit 200, and the drive unit 200 may be disposed between the discharge port 121 and the compression unit 300.

As a result, when oil is stored in a bottom surface of the case 100, the oil can be directly supplied to the compression unit 300 without passing through the drive unit 200. In addition, the rotary shaft 230 is coupled to the compression unit 300 and supports the compression unit 300, so that a separate lower frame for rotatably supporting the rotary shaft 230 can be omitted from the compressor.

On the other hand, the compressor 10 according to the embodiment of the present disclosure may enable the rotary shaft 230 to pass through the orbiting scroll 330 and the fixed scroll 320, so that the rotary shaft 230 may be designed to be in surface contact with the orbiting scroll 330 and the fixed scroll 320.

Accordingly, inflow force (suction force) generated when fluid such as refrigerant flows into the compression unit 300, gas force generated when the refrigerant is compressed in the compression unit 300, and reaction force supporting the gas force may be applied to the rotary shaft 230 without change. Therefore, the inflow force, the gas force, and the reaction force may be applied to a single action point. As a result, no overturning moments are applied to the orbiting scroll 320 connected to the rotary shaft 230, so that tilting (or vibration) or overturning of the orbiting scroll 320 can be basically prevented. In other words, even axial vibration from among vibrations generated by the orbiting scroll 330 may be attenuated or prevented, and the overturning moments of the orbiting scroll 330 may also be attenuated or suppressed. As a result, vibration and noise generated in the compressor 10 can be blocked.

In addition, the rotary shaft 230 may be in surface contact with the fixed scroll 320 in a manner that the fixed scroll 320 can be supported by the rotary shaft 230. Thus, even when the inflow force and the gas force are applied to the rotary shaft 230, durability of the rotary shaft 230 can be reinforced.

In addition, the rotary shaft 230 may absorb or support some parts of back pressure generated when the refrigerant is discharged outside, such that the rotary shaft 230 can reduce force (i.e., normal force) generated when the orbiting scroll 330 excessively and closely adheres to the fixed scroll 320 in the axial direction. As a result, frictional force between the orbiting scroll 330 and the fixed scroll 320 can be greatly reduced.

As a result, the compressor 10 may attenuate the axial tilting and overturning moments of the orbiting scroll 330 installed in the compression unit 300, and may reduce frictional force of the orbiting scroll 330, resulting in improvement in efficiency and reliability of the compression unit 300.

On the other hand, the main frame 310 from among constituent elements of the compression unit 300 may include a main end plate 311, a main side plate 312, and a main bearing 318. The main end plate 311 may be provided either at one side of the drive unit 200 or at a lower part of the drive unit 200. The main side plate 312 may extend farther from the drive unit 200 at the inner circumferential surface of the main end plate 311, and may be seated in the fixed scroll 320. The main bearing 318 may extend from the main end plate 311, and may rotatably support the rotary shaft 230.

The main end plate 311 or the main side plate 312 may further include a main hole through which refrigerant discharged from the fixed scroll 320 can be guided to the discharge port 121.

The main end plate 311 may further include an oil pocket 314 formed to be recessed at the outside of the main bearing 318. The oil pocket 314 may be formed in a circular shape, and may be eccentrically disposed in the main bearing 318. When oil stored in the isolation shell 130 is transferred through the rotary shaft 230 or the like, the oil pocket 314 may allow the oil to flow into a portion where the fixed scroll 320 is engaged with the orbiting scroll 330.

The fixed scroll 320 may include a fixed end plate 321, a fixed side plate 322, and a fixed wrap 323. The fixed end plate 321 may be coupled to the reception shell 110 in the direction farther from the drive unit 200 in the main end plate 311, and may form the other surface of the compression unit 300. The fixed side plate 322 may extend from the fixed end plate 321 to the discharge port 121, and may be in contact with the main side plate 312. The fixed wrap 323 may be provided at the inner circumferential surface of the fixed side plate 322, and may form a compression chamber in which refrigerant is compressed.

Meanwhile, the fixed scroll 320 may include a fixed through-hole 328 and a fixed bearing 3281. The fixed through-hole 328 may be formed to enable the rotary shaft 230 to pass therethrough. The fixed bearing 3281 may extend from the fixed through-hole and may rotatably support the rotary shaft. The fixed bearing 3281 may be provided at the center of the fixed end plate 321.

The fixed end plate 321 may be identical in thickness to the fixed bearing 3281. In this case, the fixed bearing 3281 may not extend without protruding from the fixed scroll 320, and may be interpolated into the fixed through-hole 328.

The fixed side plate 322 may allow the fixed wrap 323 to have an inlet hole 325 through which refrigerant is introduced, and may allow the fixed end plate 321 to have a discharge hole 326 through which the refrigerant is discharged. That is, the refrigerant may flow into the fixed wrap 323 through the suction port 111 and the inlet hole 325. Although the discharge hole 326 is provided in the central direction of the fixed wrap 323, the discharge hole 326 may be spaced apart from the fixed bearing 3281 to prevent interference with the fixed bearing 3281, and the discharge hole 326 may also be implemented as a plurality of discharge holes 326 as necessary.

The orbiting scroll 330 may include an orbiting end plate 331 disposed between the main frame 310 and the fixed scroll 320, and an orbiting wrap 333 that forms a compression chamber along with the fixed wrap 323 at the orbiting end plate 331.

The orbiting scroll 330 may further include an orbiting through-hole 338 formed to pass through the orbiting end plate 331 in a manner that the rotary shaft 230 is rotatably coupled to the orbiting through-hole 338.

The rotary shaft 230 may be designed in a manner that a portion coupled to the orbiting through-hole 338 is eccentrically formed. Thus, when the rotary shaft 230 rotates, the orbiting scroll 330 may move while being engaged with the fixed wrap 323 of the fixed scroll 320, and may thus compress the refrigerant.

Specifically, the rotary shaft 230 may include a main shaft 231 and a bearing unit 232. The main shaft 231 may be coupled to the drive unit 200, and may rotate. The bearing unit 232 may be connected to the main shaft 231, and may be rotatably coupled to the compression unit 300. The bearing unit 232 may be formed of a separate member different from the main shaft 231, so that the bearing unit 232 may include the main shaft 231 therein and may be integrally formed with the main shaft 231.

The bearing unit 232 may include a main bearing unit 232*c*, a fixed bearing unit 232*a*, and an eccentric shaft 232*b*. The main bearing unit 232*c* may be inserted into the main bearing 318 of the main frame 310, and may be supported in a radial direction. The fixed bearing unit 232*a* may be inserted into the fixed bearing 3281, and may be supported in a radial direction. The eccentric shaft 232*b* may be disposed between the main bearing unit 232*c* and the fixed bearing unit 232*c*, and may be inserted into the orbiting through-hole 338 of the orbiting scroll 330.

In this case, the main bearing unit 232*c* and the fixed bearing unit 232*c* may be coaxially formed to have the same axial center. The eccentric shaft 232*b* may have a center of gravity that is formed eccentrically in the radial direction with respect to the fixed bearing unit 232*c* or the fixed bearing unit 232*a*. In addition, the outer diameter of the eccentric shaft 232*b* may be larger than the outer diameter of the main bearing unit 232*c* or the outer diameter of the fixed bearing unit 232*a*. As such, during rotation of the bearing unit 232, the eccentric shaft 232*b* enables the orbiting scroll 330 to perform orbital motion and at the same time provides force to compress the refrigerant. The orbiting scroll 330 may regularly perform such orbital motion by the eccentric shaft 232*b* in the fixed scroll 320.

However, in order to prevent rotation of the orbiting scroll 330, the compressor 10 according to the present disclosure may further include an Oldham ring 340 coupled to an upper part of the orbiting scroll 320. The Oldham ring 340 may be disposed between the orbiting scroll 330 and the main frame 310, and may contact both the orbiting scroll 330 and the main frame 310. The Oldham ring 340 may linearly move in four directions (i.e., forward, backward, left and right) so as to prevent rotation of the orbiting scroll 330.

Meanwhile, the rotary shaft 230 may be formed to completely pass through the fixed scroll 320 such that the rotary shaft 230 may protrude outward from the compression unit 300. As a result, the rotary shaft 230 may directly contact the outside of the compression unit 300 and oil stored in the isolation shell 130. The rotary shaft 230 rotates, and at the same time supplies oil to the compression unit 300.

The oil may flow into the compression unit 300 through the rotary shaft 230. The rotary shaft 230 or the indoor space of the rotary shaft 230 may be provided with an oil supply passage 234 through which the oil can be supplied to the outer circumferential surface of the main bearing unit 232*c*, the outer circumferential surface of the fixed bearing unit 232*a*, and the outer circumferential surface of the eccentric shaft 232*b*.

In addition, a plurality of oil holes 234*a*, 234*b*, 234*c*, and 234*d* may be formed in the oil supply passage 234. In more detail, the oil holes may be classified into a first oil hole 234*a*, a second oil hole 234*b*, a third oil hole 234*c*, and a fourth oil hole 234*d*. The first oil hole 234*a* may be formed to pass through the outer circumferential surface of the main bearing unit 232*c*.

The first oil hole 234*a* may be formed to pass through the circumferential surface of the main bearing unit 232*c* in the oil supply passage 234. Although the first oil hole 234*a* is formed to pass through, for example, the upper part of the outer circumferential surface of the main bearing unit 232*c*, the scope or spirit of the present disclosure is not limited thereto. That is, the first oil hole 234*a* may also be formed to pass through the lower part of the outer circumferential surface of the main bearing unit 232*c* as needed. For reference, the first oil hole 234*a* may also include a plurality of holes differently from the drawings. If the first oil hole 234*a* includes the plurality of holes, the respective holes may also be formed only at the upper or lower part of the outer circumferential surface of the main bearing unit 232*c*, and the holes may also be respectively formed at the upper part and the lower part of the outer circumferential surface of the main bearing unit 232*c*.

In addition, the rotary shaft 230 may include an oil feeder 233. The oil feeder 233 may pass through a muffler 500 so as to contact oil stored in the case 100. The oil feeder 233 may include an extension shaft 233*a* and a spiral groove 233*b*. The extension shaft 233*a* may pass through the muffler 500 and may thus contact the oil. The spiral groove 233*b* may be spirally formed at the outer circumferential surface of the extension shaft 233*a*, and may communicate with the supply passage 234.

As a result, when the rotary shaft 230 rotates, the oil level may increase through the oil feeder 233 and the oil supply passage 234 due to the shape of the spiral groove 233*b*, viscosity of the oil, and a pressure difference between a high pressure region and an intermediate pressure region of the compression unit 300, such that the oil may be discharged to the plurality of oil holes. The oil discharged through the plurality of oil holes 234*a*, 234*b*, 234*c*, and 234*d* may form an oil film between the fixed scroll 320 and the orbiting scroll 330, may maintain an airtight state, may absorb frictional heat generated from a frictional part between the constituent elements of the compression unit 300, and may radiate heat.

The oil guided along the rotary shaft 230 through the first oil hole 234*a* may lubricate the main frame 310 and the rotary shaft 230. In addition, the oil may be discharged through the second oil hole 234*b*, and may be supplied to the top surface of the orbiting scroll 330. The oil supplied to the top surface of the orbiting scroll 330 may be guided to the intermediate pressure chamber through the pocket groove 314. For reference, oil discharged not only through the second oil hole 234*b*, but also through the first oil hole 234*a* or the third oil hole 234*d* may also be supplied to the pocket groove 314.

On the other hand, oil guided along the rotary shaft 230 may be supplied not only to the Oldham ring 340 disposed between the orbiting scroll 320 and the main frame 310, but also to the fixed side plate 322 of the fixed scroll 320, such that the degree abrasion of the fixed side plate 322 of the fixed scroll 320 and the degree of abrasion of the Oldham ring 340 can be reduced. In addition, oil supplied to the third oil hole 234*c* is also supplied to the compression chamber, such that the degree of abrasion caused by friction between the orbiting scroll 330 and the fixed scroll 320 can be reduced. In addition, an oil film is formed, and heat radiation is performed, resulting in improvement in compression efficiency.

Meanwhile, although the above-mentioned description relates to the centrifugal oil-feeding structure for allowing the compressor 10 to supply oil to the bearing using rotation of the rotary shaft 230, the scope or spirit of the present disclosure is not limited thereto, and it should be noted that the present disclosure can also be applied not only to a differential pressure oil-feeding structure for supplying oil using a difference between inner pressures of the compression unit 300, but also to a forced oil supply structure for supplying oil through a trochoid pump or the like without departing from the scope or spirit of the present disclosure.

On the other hand, the compressed refrigerant may be discharged through the discharge hole 326 along the space formed by the fixed wrap 323 and the orbiting wrap 333. It is more preferable that the discharge hole 326 be formed toward the discharge port 121. This is because it is most preferable that the refrigerant discharged through the discharge hole 326 be transferred to the discharge port 121 without a large change in the flow direction.

However, due to structural characteristics of the compressor in which the compression unit 300 should be disposed in the direction farther from the discharge port 121 in the drive unit 200 and the fixed scroll 320 should be disposed at the outermost part of the compression unit 300, the discharge hole 326 may be provided in a manner that the refrigerant can be sprayed in the direction opposite to the discharge port 121.

In other words, the discharge hole 326 may be provided in a manner that the refrigerant can be sprayed in the direction farther from the discharge port 121 in the fixed end plate 321. Therefore, when the refrigerant flows into the discharge hole 326 without change, the refrigerant may not be smoothly discharged through the discharge port 121. When the oil is stored in the isolation shell 130, there is a possibility that the refrigerant collides with the oil so that the refrigerant may be cooled or mixed with the oil.

In order to solve the above-mentioned issue, the compressor 10 according to the present disclosure may further include a muffler 500 that is coupled to the outermost portion of the fixed scroll 320 and provides a space through which the refrigerant can be guided to the discharge port 121.

The muffler 500 may be formed to seal one surface arranged in the direction farther from the discharge port 121 from among several surfaces of the fixed scroll 320 such that the refrigerant discharged from the fixed scroll 320 can be guided to the discharge port 121.

The muffler 500 may include a coupling body 520 and a reception body 510. The coupling body 520 may be coupled to the fixed scroll 320. The reception body 510 may extend from the coupling body 520, and may form a sealed space. As a result, the flow direction of the refrigerant sprayed from the discharge hole 326 may be changed along the sealed space formed by the muffler 500, such that the resultant refrigerant can be discharged through the discharge port 121.

Meanwhile, the fixed scroll 320 is coupled to the reception shell 110, such that flow of the refrigerant may be disturbed by the fixed scroll 320 and the refrigerant may have difficulty in flowing to the discharge port 121. Thus, the fixed scroll 320 may further include a bypass hole 327 that passes through the fixed end plate 321 in a manner that the refrigerant can pass through the fixed scroll 320. The bypass hole 327 may communicate with the main hole 317. As a result, the refrigerant may sequentially pass through the compression unit 300 and the drive unit 200, and may finally be discharged through the discharge port 121.

On the other hand, the refrigerant may be compressed at a higher pressure as the distance from the outer circumferential surface of the fixed wrap 323 to the innermost region of the fixed wrap 323 increases, so that the inside of the fixed wrap 323 and the inside of the orbiting wrap 333 can be maintained at a high pressure. Therefore, discharge pressure can be applied to the back surface of the orbiting scroll without change, and back pressure acting as a reaction to the discharge pressure may occur in the direction from the orbiting scroll to the fixed scroll. The compressor 10 may further include a back-pressure seal 350 that enables the back pressure to be concentrated at a coupling portion between the orbiting scroll 320 and the rotary shaft 230 so that a leakage between the orbiting wrap 333 and the fixed wrap 323 can be prevented.

The back-pressure seal 350 may be formed in a ring shape in a manner that the inner circumferential surface thereof can be maintained at a high pressure, and the outer circumferential surface of the back-pressure seal 350 may be separated to be maintained at an intermediate pressure lower than the high pressure. Thus, the back pressure can be concentrated at the inner circumferential surface of the back-pressure seal 350, so that the orbiting scroll 330 can be in close contact with the fixed scroll 320.

In this case, considering that the discharge hole 326 is spaced apart from the rotary shaft 230, the center point of the back-pressure seal 250 may be biased to the discharge hole 326. On the other hand, when refrigerant is discharged through the discharge port 121, the oil supplied to the compression unit 300 or the oil stored in the case 100 may move along with the refrigerant in an upward direction of the case 100. In this case, the oil may have higher density than the refrigerant so that the oil may not move to the discharge port 121 by centrifugal force generated by the rotor 220 and may be attached to the inner walls of the discharge shell 120 and the reception shell 110. Each of the drive unit 200 and the compression unit 300 of the compressor 10 may further include a recovery flow passage at the outer circumferential surface thereof in a manner that oil attached to the inner wall of the case 100 can be collected either in the reservoir space of the case 100 or in the isolation shell 130.

The recovery passage may include a drive recovery passage 201 provided at the outer circumferential surface of the drive unit 200, a compression recovery passage 301 provided at the outer circumferential surface of the compression unit 300, and a muffler recovery passage 501 provided at the outer circumferential surface of the muffler 500.

The drive recovery passage 201 may be formed when some parts of the outer circumferential surface of the stator 210 are recessed. The compression recovery passage 301 may be formed when some parts of the outer circumferential surface of the fixed scroll 320 are recessed. In addition, the muffler recovery passage 501 may be formed when some parts of the outer circumferential surface of the muffler are recessed. The drive recovery passage 201, the compression recovery passage 301, and the muffler recovery passage 501 may communicate with one another in a manner that oil can pass through the drive recovery passage 201, the compression recovery passage 301, and the muffler recovery passage 501.

As described above, the center of gravity of the rotary shaft 230 may be biased to one side due to the eccentric shaft 232*b*, unbalanced eccentric moments may occur in rotation of the rotary shaft 230, so that overall balance may be distorted. Therefore, the lower scroll compressor 10 according to the present disclosure may further include a balancer 400 capable of offsetting eccentric moments caused by the eccentric shaft 232*b*.

Meanwhile, since the compression unit 300 is fixed to the case 100, it is more preferable that the balancer 400 be coupled to the rotary shaft 230 or the rotor 220. Therefore, the balancer 400 may include a central balancer 410 and an outer balancer 420. The central balancer 400 may be provided either at the lower end of the rotor 220 or at one surface facing the compression unit 300 in a manner that eccentric load of the eccentric shaft 232*b* can be offset or reduced. The outer balancer 420 may be coupled to the upper end of the rotor 220 or the other surface facing the discharge port 121 in a manner that the eccentric load or the eccentric moment of at least one of the eccentric shaft 232*b* and the lower balancer 420 can be offset or cancelled.

The central balancer 410 may be provided in relatively close proximity to the eccentric shaft 232*b*, so that the central balancer 410 can directly offset the eccentric load of the eccentric shaft 232*b*. Thus, the central balancer 410 may be biased in the direction opposite to the eccentric direction of the eccentric shaft 232*b*. As a result, even when the rotary shaft 230 rotates at a low speed or at a high speed, the rotary shaft 230 is located closer to the eccentric shaft 232*b*, so that eccentric force or eccentric load generated by the eccentric shaft 232*b* can be effectively offset or cancelled in a substantially uniform manner.

The outer balancer 420 may also be biased in the direction opposite to the eccentric direction of the eccentric shaft 232*b*. However, the outer balancer 420 may also be biased in the direction corresponding to the eccentric shaft 232*b* in a manner that the eccentric load generated by the central balancer 410 can be partially offset or cancelled.

Thus, the central balancer 410 and the outer balancer 420 may offset the eccentric moments generated by the eccentric shaft 232*b*, and may assist the rotary shaft 230 to stably rotate.

Figure 2:
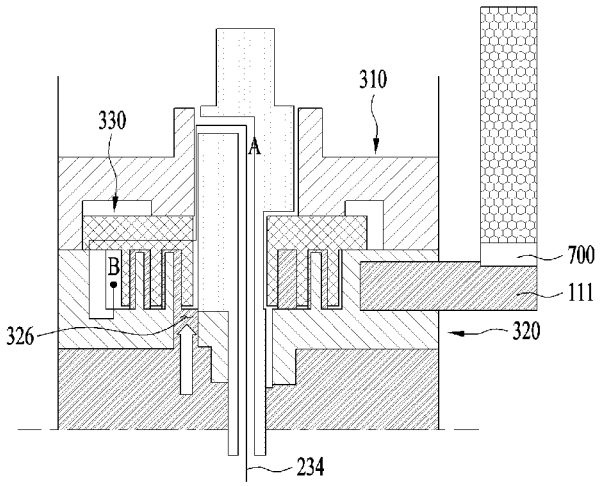
FIG. 2 is a view illustrating a suction valve and a discharge valve provided in a conventional compressor.
Figure 2:
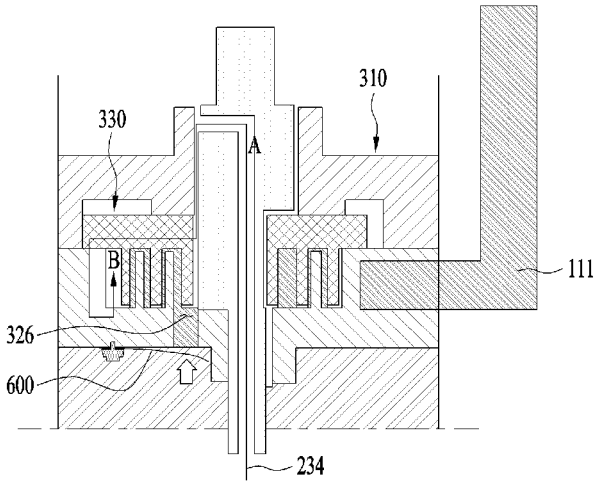

FIG. 2 is a view showing a suction valve and a discharge valve provided in a conventional compressor.

Specifically, FIG. 2(*a*) shows the suction valve 700 provided in the suction port 111, and FIG. 2(*b*) shows the discharge valve 600 provided in the fixed scroll 320.

Referring to FIG. 2(*a*), the suction valve 700 may be provided at the suction port 111.

When the operation of the compressor 10 is stopped, the refrigerant flowing back through the discharge hole 326 may be prevented from flowing out due to the suction valve 700. In addition, the region B of the compression unit 300 may be maintained at a high pressure.

Accordingly, the oil stored in the case 100 may not be supplied into the compression unit 300 because a difference in pressure in the region A where the oil is discharged from the oil supply passage 234 is not large.

Therefore, the level of the oil stored in the case 100 is kept constant to prevent a drop in the oil level.

However, when the compressor 10 having the differential pressure oil-feeding structure stops operation, the compressed high-temperature and high-pressure refrigerant flows back through the discharge hole 326, reversely rotating the orbiting scroll 330.

Reverse rotation of the orbiting scroll 330 may cause breakage and damage to the orbiting scroll 330 and the fixed scroll 320. In addition, noise may be generated due to the reverse rotation of the orbiting scroll 330.

Referring to FIG. 2(*b*), the discharge valve 600 capable of opening and closing the discharge hole 326 may be provided at one surface of the fixed scroll 320 facing the muffler 500.

When the compressor 10 stops operation, the refrigerant compressed and discharged from the compression unit 300 in a high-temperature and high-pressure state may be prevented from flowing back into the compression unit 300 by the discharge valve 600.

Accordingly, reverse rotation of the orbiting scroll 330 can be prevented. In addition, breakage of and damage to the orbiting scroll 330 and the fixed scroll 320 can be prevented. Furthermore, the amount of noise generated when the compressor 10 is stopped can be reduced.

However, the pressure of the compression unit 300 may be rapidly reduced so that the region (B) of the compression unit 300 may be maintained at a low pressure.

As a result, a difference in pressure between the region A where the oil is discharged and the oil supply passage 234 becomes larger, so that the oil stored in the case 100 can be supplied into the compression unit 300.

Accordingly, the oil level drop phenomenon in which the level of the oil stored in the case 100 decreases may occur. In addition, the oil may fill the compression unit 300 and the suction port 111. Accordingly, when the compressor 10 is restarted and left in a cold state, it may be impossible for the compressor 10 to operate due to occurrence of high-viscosity oil.

Figure 3:
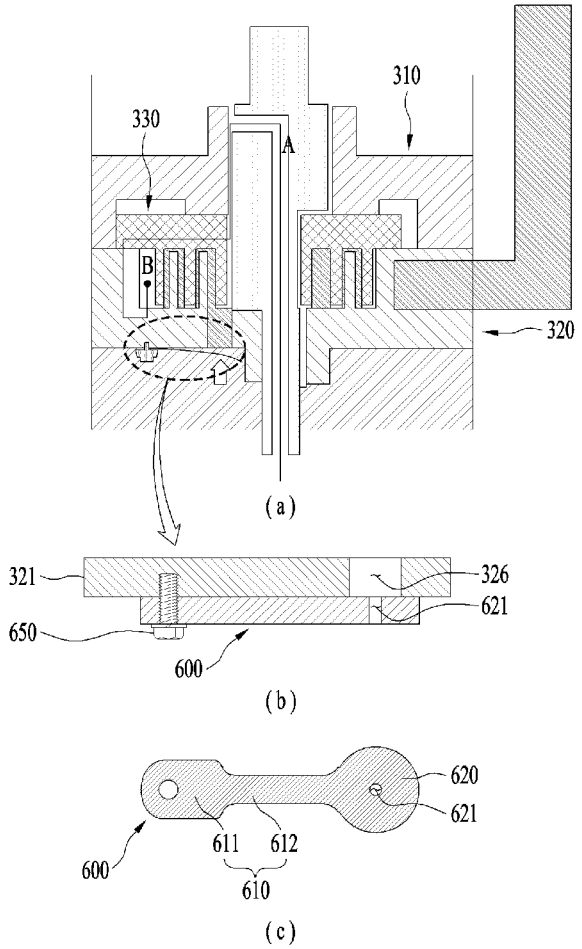
FIG. 3 is a view illustrating an example of a communication hole provided in the discharge valve according to an embodiment of the present disclosure.
Figure 4:
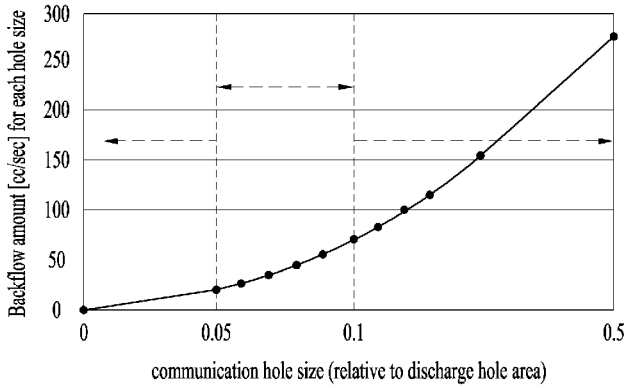
FIG. 4 is a graph illustrating the amount of reverse flow of refrigerant gas that was discharged according to the area of the communication hole.
Figure 4:
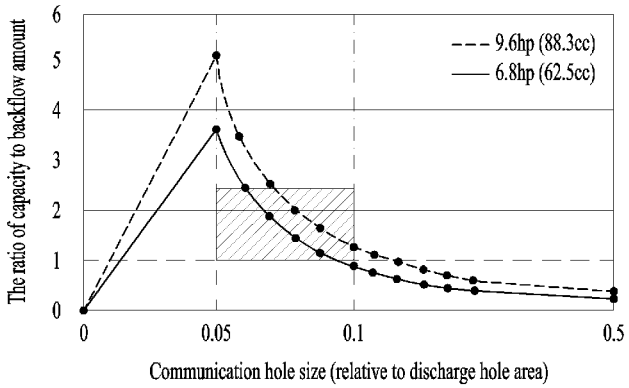

FIG. 3 is a view illustrating an example of a communication hole provided in the discharge valve according to an embodiment of the present disclosure. FIG. 4 is a graph illustrating the amount of reverse flow of refrigerant gas that was discharged according to the area of the communication hole.

Specifically, FIG. 3(*a*) illustrates a compressor further including a communication hole 621 in the discharge valve 600 shown in FIG. 2(*b*), and FIG. 3(*b*) illustrates that a discharge valve 600 is coupled to one surface of the fixed scroll 320 and includes a communication hole 621, and FIG. 3(*c*) illustrates the shape of the discharge valve 600 provided with a communication hole 621.

Referring to FIG. 3(*a*), the compressor 10 according to the embodiment of the present disclosure may further include a discharge valve 600 coupled to the fixed scroll 320.

Specifically, the discharge valve 600 may include a coupling portion 610 coupled to one surface facing the muffler 500 of the fixed scroll 320. Also, the discharge valve 600 may include a head portion 620 that extends from the coupling portion 610 to open and close the discharge hole 326.

When the compressor 10 is operated under a condition higher than the designed compression ratio, the internal pressure of the compressor 10 becomes higher than the discharge pressure of the compression unit 300, so that a reverse flow of the discharged refrigerant may occur. The high-pressure refrigerant flowing backward may be recompressed by the compression unit 300 and overcompression may occur. If pressure higher than the designed pressure occurs d due to overcompression, the reliability of the compression unit 300 may be reduced.

The head portion 620 may prevent a reverse flow of the refrigerant discharged when the compressor 10 is operated. Accordingly, the compressor 10 may operate at a high pressure ratio, and the compression efficiency of the compressor 10 may increase.

The head portion 620 may include a communication hole 621 provided to communicate the discharge hole 326 with the muffler 500. That is, the communication hole 621 may be provided to pass through the head portion 620.

When the compressor 10 is operated, the discharge valve 600 may be open or closed so that the refrigerant compressed at high temperature and high pressure can be discharged in the direction of the muffler 500 from the discharge hole 326. That is, the refrigerant compressed at high temperature and high pressure may be discharged while pushing the head portion 620 toward the muffler 500. Also, the refrigerant compressed at high temperature and high pressure may be discharged through the communication hole 621 provided in the head portion 620.

In addition, as described above, the head portion 620 may prevent a reverse flow of the discharged refrigerant. Conversely, the refrigerant discharged through the communication hole 621 may partially flow backward.

Accordingly, when the compressor 10 is operated, only a portion of the refrigerant flows backward, so that the compressor 10 can operate at a high pressure ratio and the compression efficiency of the compressor 10 can be increased. However, if the area of the communication hole 621 excessively increases in size, the above-described effects cannot be obtained, so that an optimal design may be required. Details on the optimal design will be described later.

When the compressor 10 stops operation, the discharge valve 600 may prevent a reverse flow of the refrigerant discharged after being compressed at high temperature and high pressure. Specifically, the head portion 620 may block the discharge hole 326 to close a flow passage of the refrigerant that was compressed at high temperature and high pressure and discharged.

In addition, when the compressor 10 stops operation, the communication hole 621 may allow a portion of the refrigerant discharged after being compressed at high temperature and high pressure to flow back to the discharge hole 326. Specifically, it is possible to secure a certain portion of the flow passage of the refrigerant compressed and discharged at high temperature and high pressure.

Accordingly, the compression unit 300 can maintain a constant pressure even when the compressor 10 is stopped. That is, only some of the refrigerant compressed and discharged at high temperature and high pressure is reversed to prevent reverse rotation of the orbiting scroll 330. In addition, since the compression unit 300 maintains a constant pressure, it is possible to prevent the oil stored in the case 100 from being supplied by a differential pressure between the oil supply passage 234 and the compression unit 300.

Accordingly, the compressor may prevent reverse rotation of the orbiting scroll 330, thereby preventing occurrence of noise. In addition, the compressor may prevent reverse rotation of the orbiting scroll 330, so that damage to the orbiting scroll 330 and the fixed scroll 320 can be prevented. In addition, in the differential pressure oil-feeding structure, it is possible to prevent a decrease in the oil level of the oil stored in the case 100 when the compressor 10 is stopped.

In addition, in the differential pressure oil-feeding structure, the oil may be prevented from flowing into the compression unit 300 and the suction port 111 when the compressor 10 is stopped.

In addition, when the compressor 10 is stopped, the oil is prevented from flowing into the compression unit 300 and the suction port 111, so that the operation unable state of the compressor 10 affected by high-viscosity oil generated when the compressor is restarted or left in a cold state can be prevented.

Also, the communication hole 621 may be arranged to coincide with the center of the discharge hole 326. Since the communication hole 621 is arranged to coincide with the center of the discharge hole 326, some of the refrigerant can effectively flow back to the discharge hole 326 even when the communication hole 621 has a small cross-sectional area.

That is, the position where the communication hole 621 is provided in the head portion 620 may be implemented in consideration of a cross-sectional area of the head portion 620, a cross-sectional area of the communication hole 621, the operating pressure of the compressor 10, and the like. In other words, the center of the communication hole 621 may be provided closer to or farther from the center of the discharge hole 326 with respect to the rotary shaft 230.

FIG. 4(*a*) is a graph illustrating a backflow amount (cc/sec) of the refrigerant compressed and discharged at high temperature and high pressure according to the size of a communication hole (i.e., the ratio of the area of the communication hole to the area of the discharge hole). FIG. 4(*b*) is a graph illustrating the ratio of the capacity of the compressor according to the size of the communication hole (i.e., the ratio of the area of the communication hole to the area of the discharge hole) to the backflow amount of the refrigerant compressed and discharged at high temperature and high pressure.

Referring to FIG. 4(*a*), in the compressor 10 according to an embodiment of the present disclosure, the cross-sectional area of the communication hole 621 may be 5% to 10% of the cross-sectional area of the discharge hole 326.

That is, when the ratio (r) of the cross-sectional area of the communication hole 621 to the cross-sectional area of the discharge hole 326 is 0.05 to 0.1, the compressor 10 is operated under a condition higher than the lab-designed compression ratio so that the internal pressure of the compressor 10 becomes higher than the discharge pressure of the compression unit 300. As a result, even if the reverse flow of the discharged refrigerant occurs, most of the reverse flow of the refrigerant can be prevented by the head portion 620. Although a portion of the refrigerant flows backward through the communication hole 621, overcompression of the compression unit 300 may be prevented. Accordingly, overcompression of the compression unit 300 is prevented, so that a pressure higher than the designed pressure is not generated, thereby guaranteeing reliability of the compression unit 300.

Also, when the compressor 10 is stopped, the head portion 620 may prevent a reverse flow of the refrigerant discharged after being compressed at high temperature and high pressure. Specifically, the head portion 620 may block the discharge hole 326 to close a flow passage of the refrigerant that was compressed and discharged at high temperature and high pressure.

However, when the compressor 10 is stopped, the communication hole 621 may allow a portion of the refrigerant discharged after being compressed at high temperature and high pressure to flow back to the discharge hole 326. Specifically, it is possible to secure a certain portion of the flow passage of the refrigerant compressed and discharged at high temperature and high pressure.

Accordingly, the compression unit 300 can maintain a constant pressure even when the compressor 10 is stopped. Accordingly, the oil level drop phenomenon of the oil stored in the case 100 can be prevented.

In addition, when the compressor 10 is stopped, the backflow amount of the refrigerant compressed and discharged at high temperature and high pressure is very small, thereby preventing reverse rotation of the orbiting scroll 330.

When the ratio (r) of the cross-sectional area of the communication hole 621 to the cross-sectional area of the discharge hole 326 is 0 to 0.05, the backflow amount of the refrigerant compressed and discharged at high temperature and high pressure is very small when the compressor 10 is stopped, so that reverse rotation of the orbiting scroll 330 can be prevented. However, since the compression unit 300 is maintained at a low pressure, a differential pressure between the oil supply passage 234 and the compression unit 300 increases, so that the oil stored in the case 100 may be supplied. Thus, a decrease in the level of the oil stored in the case 100 may occur.

When the ratio (r) of the cross-sectional area of the communication hole 621 to the cross-sectional area of the discharge hole 326 is greater than 0.1, the backflow amount of the refrigerant discharged after being compressed at high temperature and high pressure when the compressor 10 is stopped may increase. As a result, the compression unit 300 is maintained at a certain level or higher, and the differential pressure between the oil supply passage 234 and the compression unit 300 is reduced, thereby preventing a decrease in the level of the oil stored in the case 100. However, reverse rotation of the orbiting scroll 330 may occur.

In addition, the communication hole 621 may be formed in a cylindrical shape. When the communication hole 621 is provided in a cylindrical shape, abrasion caused by the refrigerant compressed at high temperature and high pressure is reduced compared to the communication hole 621 formed in a polygonal shape, so that the cross-sectional area of the communication hole 621 may be prevented from being changed. In other words, if abrasion of the communication hole 621 becomes severe, the communication hole 621 is increased in size, so that the above-described effects of the communication hole 621 cannot be obtained.

Referring to FIG. 4(*b*), when the cross-sectional area of the communication hole 621 is 5% to 10% of the cross-sectional area of the discharge hole 326, the ratio of the capacity of the compressor 10 to the backflow amount of the refrigerant may be 1 to 2.5.

That is, when the cross-sectional area of the communication hole 621 is 5% to 10% of the cross-sectional area of the discharge hole 326, a decrease in the level of oil stored in the case 100 can be prevented regardless of the capacity of the compressor 10, so that reverse rotation of the orbiting scroll 330 can be prevented.

Referring to FIGS. 3(*b*) and 3(*c*), in the compressor according to an embodiment of the present disclosure, the cross-section of the head portion 620 may be formed in a shape corresponding to the cross-section of the discharge hole 326.

The cross-section of the head portion 620 may be formed in a shape corresponding to the cross-section of the discharge hole 326, so that the head portion 620 is provided with a minimum cross-sectional area to open and close the discharge hole 326. Specifically, the head portion 620 may have the same cross-sectional area as the discharge hole 326. That is, it is possible to reduce the manufacturing costs in the process of manufacturing the discharge valve 600. In addition, when the head portion 620 is opened and/or closed, the frictional area with the discharge hole 326 can be reduced in size, thereby ensuring durability of the compressor.

Referring to FIGS. 3(*b*) and 3(*c*), the discharge hole 326 may be formed in a cylindrical shape, and the head portion 620 may be formed in a disk shape, so that both the head portion 620 and the discharge hole 326 may be formed in a circular shape. This is only an example. The shape of the discharge hole 326 is not limited as long as the refrigerant compressed at high temperature and high pressure can be discharged through the discharge hole 326. That is, the head portion 620 may have a cross-section corresponding to the cross-section of the discharge hole 326.

The coupling portion 610 may include a fastening portion 611 coupled to one surface of the fixed scroll 320. The coupling portion 610 may include an extension portion 612 that extends from the coupling portion 611 and has a cross-sectional area smaller than that of the fastening portion 611. The extension portion 612 may be connected to the head portion 620.

The fastening portion 611 may be formed to have a wide cross-sectional area, so that the fastening portion 611 may be easily fastened to one surface of the fixed scroll 320. The extension portion 612 may have a smaller cross-sectional area than the fastening portion 611. When the head portion 620 is pushed toward the muffler 500 by the refrigerant that was discharged through the head portion 620, the extension portion 612 may be pushed toward the muffler 500 together with the head portion 620.

Since the extension portion 612 has a smaller cross-sectional area, the extension portion 612 can be easily pushed toward the muffler 500 by the refrigerant compressed together with the head portion 620, so that the refrigerant can be easily discharged in the direction from the discharge hole 326 to the muffler 500.

In addition, the length of the extension portion 612 arranged in the central direction of the rotary shaft 230 may be longer than the length of the fastening portion 611 arranged in the central direction of the rotary shaft 230. That is, the head portion 620 from the fastening portion 611 can be secured by a predetermined distance or more due to the length of the extension portion 612. A sufficient distance between the fastening portion 611 and the discharge hole 326 can be secured.

Since the fastening portion 611 is coupled to one surface of the fixed scroll 320 and has a larger cross-sectional area than the extension portion 612, it is easy to manufacture the extension portion 612 having a longer length rather than the fastening portion 611 having a longer length, resulting in reduction in production costs.

Accordingly, when the refrigerant compressed at high temperature and high pressure is discharged, the head portion 620 and the extension portion 612 can be easily pushed, so that the refrigerant can be easily discharged outside.

In addition, the discharge valve 600 may be formed of an elastic member. Accordingly, when the refrigerant is discharged, the head portion 620 and the extension portion 612 may be pushed toward the muffler 500. Conversely, when the refrigerant is not discharged, the extension portion 612 is supported by one surface of the fixed scroll 320 so that the extension portion 612 and the head portion 620 may maintain their positions. Accordingly, it is possible to prevent the discharged refrigerant from flowing backward into the discharge hole 326.

In addition, the fastening portion 611 may be provided as a member having rigidity greater than those of the extension portion 612 and the head portion 620. That is, the fastening portion 611 may be formed of a material having greater rigidity than the extension portion 612 and the head portion 620. As a result, although the extension portion 612 and the head portion 620 open and close the discharge hole 326 and the fastening portion 611 is coupled to one surface of the fixed scroll 320, the fastening portion 611 can be prevented from being structurally deformed as much as possible.

The fastening portion 611 may include a first coupling hole (not shown) to be coupled to one surface of the fixed scroll 320. The fastening portion 611 may be screw-coupled to one surface of the fixed scroll 320 through the first coupling hole. Accordingly, the coupling between the discharge valve 600 and the fixed scroll 320 may be strongly maintained, and repair and replacement of the constituent elements included in the compressor can be facilitated.

Figure 5:
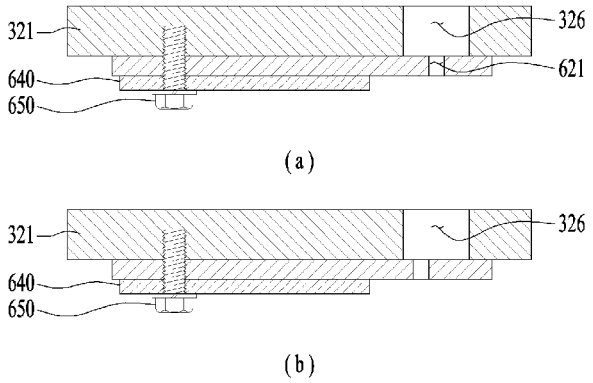
FIG. 5 is a view illustrating an example of a stopper provided in the discharge valve according to an embodiment of the present disclosure.

FIG. 5 is a view illustrating an example of a stopper provided in the discharge valve according to an embodiment of the present disclosure. Specifically, FIG. 5(*a*) shows that a stopper is provided in the discharge valve and the center of the discharge hole is arranged to coincide with the center of the communication hole. FIG. 5(*b*) shows that a stopper is provided in the discharge valve and the center of the discharge hole is arranged to coincide with the center of the communication hole.

Referring to FIG. 5(*a*), in the compressor 10 according to an embodiment of the present disclosure, a stopper 640 may be coupled to the discharge valve 600. Specifically, the compressor 10 may include a fastening member 650 coupled to one surface of the fixed scroll 320 that faces the muffler 500 after passing through the fastening portion 611 and the stopper 640.

In other words, the fastening portion 611 may include a first coupling hole (not shown) provided through the fastening portion. In addition, the stopper 640 may include a second coupling hole (not shown) having the same center as the first coupling hole. The fastening member 650 may be screw-coupled to one surface of the fixed scroll 320 after passing through the first coupling hole and the second coupling hole.

Accordingly, the discharge valve 600 and the stopper 640 may have a strong coupling force. In addition, only one fastening member 650 may be provided to facilitate installation thereof, and the internal space of the compressor 10 can be easily utilized.

The stopper 640 may limit the opening displacement of the discharge valve 600. That is, the backflow amount of the refrigerant discharged before the compressor 10 is stopped and the discharge valve 600 is closed may be increased. Therefore, the backflow amount of the refrigerant discharged when the opening displacement of the discharge valve 600 is restricted through the stopper 640 may be minimized, and only some of the refrigerant may flow backward through the communication hole 621, so that reverse rotation of the orbiting scroll 330 can be prevented and a decrease in the level of oil stored in the case 100 can also be prevented.

Hereinafter, FIG. 5(*b*) will be described. The description of the content repeatedly described in FIG. 5(*a*) will herein be omitted. However, all of the same content as the above-described content is not omitted, and some content may be described again for convenience of description and better understanding of the present disclosure. In addition, the omitted content should not be excluded or interpreted independently.

Referring to FIG. 5(*b*), in the compressor according to an embodiment of the present disclosure, the center of the communication hole 621 may be provided closer to the fastening portion 611 than the center of the discharge hole 326.

Specifically, the opening displacement of the discharge valve 600 is limited by the stopper 640 and the backflow amount of the discharged refrigerant is reduced, so that a decrease in the level of the oil stored in the case 100 may occur. Accordingly, the communication hole 621 may be provided closer to the fastening portion 611. That is, the discharge hole 326 is closed from the head portion 620 located closer to the fastening portion 611. Thus, when the communication hole 621 is provided closer to the fastening portion 611, the backflow amount of the discharged refrigerant can be sufficiently secured.

Accordingly, reverse rotation of the orbiting scroll 330 is prevented and a decrease in the level of oil stored in the case 100 can be prevented.

Figure 6:
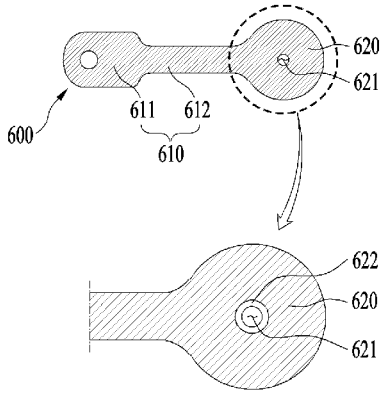
FIG. 6 is a view illustrating an example of a coating member provided in the communication hole according to an embodiment of the present disclosure.

FIG. 6 is a view illustrating an example of a coating member provided in the communication hole according to an embodiment of the present disclosure.

Hereinafter, FIG. 6 will be described. The description of the content repeatedly described in FIG. 3 will herein be omitted. However, all of the same content as the above-described content is not omitted, and some content may be described again for convenience of description and better understanding of the present disclosure. In addition, the omitted content should not be excluded or interpreted independently.

In the compressor 10 according to the present embodiment, a coating member 622 may be provided on the inner surface of the communication hole 621. That is, when the refrigerant compressed at high temperature and high pressure is discharged or flows backward, the inner surface of the communication hole 621 may be worn to change the cross-sectional area of the communication hole 621.

As described above, the cross-sectional area of the communication hole 621 is an important factor capable of determining the backflow amount of the discharged refrigerant. Accordingly, the coating member 622 is provided on the inner surface of the communication hole 621 to prevent the inner surface of the communication hole 621 from being worn.

Although not shown in the drawings, the compressor includes the coating member 622, and the inner surface of the communication hole 621 is coated, so that the inner surface of the communication hole 621 can be prevented from being worn. That is, the coating method can be freely selected in consideration of the operating pressure of the compressor 10, the operating speed of the compressor 10, the temperature of the compressed refrigerant, and the like.

In addition, when the coating member 622 is provided in the communication hole 621, the cross-sectional area excluding the cross-sectional area of the coating member 622 from the cross-sectional area of the communication hole 621 may be 5% to 10% of the cross-sectional area of the discharge hole 326.

As a result, the compressor can prevent abrasion of the inner surface of the communication hole 621, so that reverse rotation of the orbiting scroll 330 can be continuously prevented and a decrease in the level of oil stored in the case 100 can also be continuously prevented.

While exemplary embodiments of the present disclosure have been described in detail above, it will be understood by those skilled in the art that various modifications may be made without departing from the scope of the present disclosure. Therefore, the scope of the present disclosure should not be limited to the described embodiments, and should be determined not only by the claims which will be described later but also equivalent to the claims.

The invention claimed is:

1. A compressor comprising:

a case defining a discharge port configured to discharge refrigerant;

a driver coupled to an inner circumferential surface of the case;

a rotary shaft coupled to the driver and configured to rotate;

a compression unit coupled to the rotary shaft and configured to compress the refrigerant to thereby discharge the refrigerant in a direction away from the discharge port; and a muffler coupled to the compression unit and configured to guide the refrigerant to the discharge port, wherein the compression unit includes:

an orbiting scroll coupled to the rotary shaft and configured to orbit based on the rotary shaft rotating, a fixed scroll engaging the orbiting scroll and configured to receive the refrigerant to thereby compress and discharge the refrigerant, a discharge hole defined at the fixed scroll and configured to spray the refrigerant in the direction away from the discharge port, and a discharge valve coupled to the fixed scroll and configured to open and close the discharge hole, wherein the discharge valve includes:

a coupling portion coupled to a surface of the fixed scroll that faces the muffler, and a head portion extending from the coupling portion and configured to open and close the discharge hole, wherein the head portion defines a communication hole configured to enable fluid communication between the discharge hole and the muffler, wherein the case defines a reservoir space configured to store oil, wherein the reservoir space is located lower than the compression unit, and wherein a cross-sectional area of the communication hole is 5% to 10% of a cross-sectional area of the discharge hole.

2. The compressor according to claim 1, wherein a center of the communication hole coincides with a center of the discharge hole.

3. The compressor according to claim 1, wherein the communication hole is defined in a cylindrical shape.

4. The compressor according to claim 1, wherein the head portion is defined in a shape corresponding to the discharge hole.

5. The compressor according to claim 4, wherein the head portion has a same cross-sectional area as the discharge hole.

6. The compressor according to claim 1, wherein the coupling portion includes:

a fastening portion fastened to the surface of the fixed scroll; and an extension portion extending from the fastening portion and being connected to the head portion, the extension portion having a cross-sectional area smaller than a cross-sectional area of the fastening portion.

7. The compressor according to claim 6, wherein a length of the extension portion in a direction toward a center of the rotary shaft is longer that a length of the fastening portion in the direction toward the center of the rotary shaft.

8. The compressor according to claim 6, further comprising:

a stopper coupled to the fastening portion and configured to limit an opening displacement of the discharge valve.

9. The compressor according to claim 8, further comprising:

a fastener passing through the fastening portion and the stopper and coupled to the surface of the fixed scroll.

10. The compressor according to claim 8, wherein a center of the communication hole is located closer to the fastening portion than a center of the discharge hole is.

11. The compressor according to claim 6, wherein the fastening portion includes a material having a higher rigidity than the extension portion and the head portion.

12. The compressor according to claim 1, further comprising:

a coating applied at an inner surface of the communication hole.

13. The compressor according to claim 1, wherein the rotary shaft is configured to receive the oil from the reservoir space and provide the oil to the orbiting scroll and the fixed scroll, and wherein the communication hole allows a portion of the refrigerant discharged through the discharge hole to flow backward to thereby maintain internal pressure of the orbiting scroll and internal pressure of the fixed scroll at a predetermined pressure or higher.

14. The compressor according to claim 13, wherein the communication hole is configured to maintain a difference in pressure between the reservoir space and a space defined by the orbiting scroll and the fixed scroll within a predetermined range to thereby restrict a decrease in a level of the oil stored in the reservoir space.

15. A compressor comprising:

a case defining a discharge port configured to discharge refrigerant;

a driver coupled to an inner circumferential surface of the case;

a compression unit including:

an orbiting scroll;

a fixed scroll engaging the orbiting scroll and configured to receive refrigerant to thereby compress between the orbiting scroll and the fixed scroll;

a discharge hole defined at the fixed scroll and configured to discharge the refrigerant; and a discharge valve coupled to the fixed scroll and configured to open and close the discharge hole, the discharge valve including:

a coupling portion coupled to a surface of the fixed scroll, and a head portion extending from the coupling portion and configured to open and close the discharge hole, the head portion defining a communication hole that is in fluid communication with the discharge hole, wherein the case defines a reservoir space configured to store oil, wherein the reservoir space is located lower than the compression unit, and wherein a cross-sectional area of the communication hole is 5% to 10% of a cross-sectional area of the discharge hole.

16. The compressor of claim 15, wherein a center of the communication hole coincides with a center of the discharge hole.

17. The compressor of claim 15, wherein the communication hole is defined in a cylindrical shape.

18. The compressor of claim 15, wherein the head portion is defined in a shape corresponding to the discharge hole.

* * * * *